US011959687B2

(12) United States Patent
Miller

(10) Patent No.: US 11,959,687 B2
(45) Date of Patent: Apr. 16, 2024

(54) WATER BALLAST CLEAR ICEMAKING DEVICE AND REFRIGERATOR APPLIANCE INCLUDING THE SAME

(71) Applicant: Haier US Appliance Solutions, Inc., Wilmington, DE (US)

(72) Inventor: Charles Benjamin Miller, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/722,520

(22) Filed: Apr. 18, 2022

(65) Prior Publication Data

US 2023/0332817 A1 Oct. 19, 2023

(51) Int. Cl.

| | |
|---|---|
| ***F25C 1/25*** | (2018.01) |
| ***F25C 1/18*** | (2006.01) |
| ***F25C 1/24*** | (2018.01) |

(52) U.S. Cl.

CPC ..... *F25C 1/25* (2018.01); *F25C 1/18* (2013.01); *F25C 1/24* (2013.01); *F25C 2400/14* (2013.01); *F25C 2700/04* (2013.01); *F25C 2700/14* (2013.01)

(58) Field of Classification Search

CPC ..... F25C 1/25; F25C 1/18; F25C 1/24; F25C 2400/14; F25C 2700/04; F25C 2700/14

USPC ..... 62/66

See application file for complete search history.

(56) References Cited

U.S. PATENT DOCUMENTS

| | | | | |
|---|---|---|---|---|
| 1,348,352 | A * | 8/1920 | Edwards | F25C 1/02 62/304 |
| 5,187,948 | A * | 2/1993 | Frohbieter | F25C 1/18 62/353 |
| 5,653,114 | A * | 8/1997 | Newman | F25C 5/10 62/347 |
| 6,041,607 | A * | 3/2000 | Kim | F25C 1/25 137/487.5 |
| 7,043,929 | B2 * | 5/2006 | Wang | B67D 3/0009 62/389 |
| 8,176,930 | B2 * | 5/2012 | Takagi | F25C 1/24 62/340 |
| 9,784,492 | B2 | 10/2017 | Little et al. | |
| 10,443,915 | B2 | 10/2019 | Little et al. | |
| 10,788,250 | B2 | 9/2020 | Junge et al. | |
| 2001/0039804 | A1 * | 11/2001 | Newman | F25C 1/12 62/66 |

(Continued)

FOREIGN PATENT DOCUMENTS

WO WO2018141779 A1 8/2018

*Primary Examiner* — Eric S Ruppert
*Assistant Examiner* — Kirstin U Oswald
(74) *Attorney, Agent, or Firm* — Dority & Manning, P.A.

(57) ABSTRACT

An icemaker appliance includes a container defining a liquid reservoir, an ice mold selectively received within a portion of the liquid reservoir, a temperature sensor provided within the liquid reservoir and configured to monitor a temperature of the liquid, a water level sensor provided within the liquid reservoir and configured to determine a level of the liquid within the container, and a controller attached to the container, the controller being operably connected with the temperature sensor and the water level sensor, the controller including a wireless communication module configured to wirelessly communicate with a remote terminal.

18 Claims, 6 Drawing Sheets

(56) References Cited

U.S. PATENT DOCUMENTS

| | | | | |
|---|---|---|---|---|
| 2006/0158959 | A1* | 7/2006 | Huang | B01F 27/90 366/251 |
| 2007/0058315 | A1* | 3/2007 | Maddox | A61H 33/005 361/103 |
| 2008/0072610 | A1* | 3/2008 | Venkatakrishnan | F25C 1/04 62/135 |
| 2009/0152438 | A1* | 6/2009 | Chu | F25C 1/24 249/105 |
| 2014/0208781 | A1* | 7/2014 | Broadbent | F25C 5/185 62/66 |
| 2014/0270725 | A1* | 9/2014 | Bertolini | B67D 7/82 392/341 |
| 2015/0276265 | A1* | 10/2015 | Davari | H04L 12/2818 700/300 |
| 2016/0282028 | A1 | 9/2016 | Boehringer et al. | |
| 2017/0370628 | A1* | 12/2017 | Knatt | F25C 1/25 |
| 2018/0335238 | A1* | 11/2018 | Denigan, III | F25C 1/08 |
| 2020/0072522 | A1* | 3/2020 | Murphy | F25C 1/22 |
| 2020/0370812 | A1* | 11/2020 | Broadbent | F25C 5/10 |

* cited by examiner

WATER BALLAST CLEAR ICEMAKING DEVICE AND REFRIGERATOR APPLIANCE INCLUDING THE SAME

FIELD OF THE INVENTION

The present subject matter relates generally to icemaking devices, and more particularly to water ballast icemaking devices.

BACKGROUND OF THE INVENTION

In domestic and commercial applications, ice is often formed as solid cubes, such as crescent cubes or generally rectangular blocks. The shape of such cubes is often dictated by the container holding water during a freezing process. For instance, an ice maker can receive liquid water, and such liquid water can freeze within the ice maker to form ice cubes. In particular, certain ice makers include a freezing mold that defines a plurality of cavities. Although the typical solid cubes or blocks may be useful in a variety of circumstances, they have certain drawbacks. For instance, such typical cubes or blocks are fairly cloudy due to impurities found within the freezing mold or water. As a result, certain consumers find clear ice preferable to cloudy ice. In clear ice formation processes, dissolved solids typically found within water (e.g., tap water) are separated out and essentially pure water freezes to form the clear ice.

Several different methods of forming clear ice are known. One such method incorporates a water ballast and an ice mold suspended within the ballast. However, further improvements are necessary to improve the creation of clear ice cubes. For instance, the formed ice cubes must be removed from the water ballast before the ballast itself freezes. Further, current water ballast ice molds involve complicated filling procedures.

Accordingly, an icemaking device that obviates one or more of the above-mentioned drawbacks would be beneficial. In particular, an icemaking device with improved filling and monitoring abilities would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an icemaker appliance is provided. The icemaker appliance may include a container defining a liquid reservoir storing a liquid, an ice mold selectively received within a portion of the liquid reservoir, the ice mold defining a plurality of cavities accepting the liquid therein, a temperature sensor provided within the liquid reservoir and configured to monitor a temperature of the liquid, and a controller attached to the container, the controller being operably connected with the temperature sensor. The controller may include a wireless communication module configured to wirelessly communicate with a remote terminal.

In another exemplary aspect of the present disclosure, a refrigerator appliance is provided. The refrigerator appliance may include a cabinet defining a fresh food chamber and a freezer chamber, and an icemaker provided within the freezer chamber. The icemaker may include a container defining a liquid reservoir storing a liquid, an ice mold selectively received within a portion of the liquid reservoir, the ice mold defining a plurality of cavities accepting the liquid therein, a temperature sensor provided within the liquid reservoir and configured to monitor a temperature of the liquid, and a controller attached to the container, the controller being operably connected with the temperature sensor. The controller may include a wireless communication module configured to wirelessly communicate with a remote terminal.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
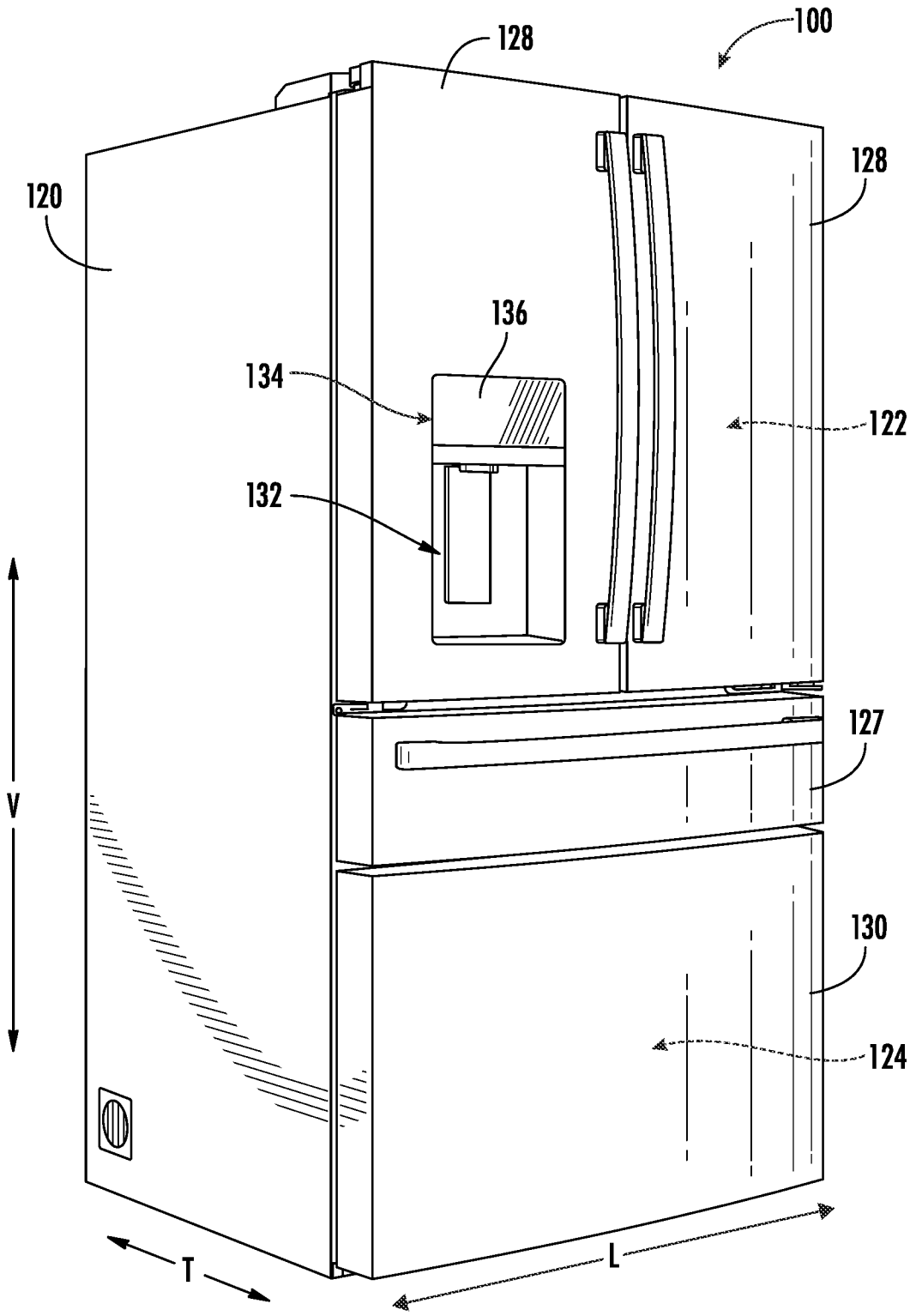
FIG. 1 provides a perspective view of a refrigerator appliance according to an exemplary embodiment of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a perspective view of an exemplary embodiment of a refrigerator appliance 100. Refrigerator appliance 100 extends between a top and a bottom along a vertical direction V. Refrigerator appliance 100 also extends between a first side and a second side along a lateral direction L. A transverse direction T may additionally be defined perpendicular to the vertical and lateral directions V, L. Refrigerator appliance 100 extends along the transverse direction T between a front portion and a back portion.

Refrigerator appliance 100 may include a cabinet or housing 120 defining an upper fresh food chamber 122 and a lower freezing chamber or frozen food storage chamber 124 arranged below the fresh food chamber 122 along the vertical direction V. An auxiliary food storage chamber may be positioned between the fresh food storage chamber 122 and the frozen food storage chamber 124, e.g., along the vertical direction V. Because the frozen food storage chamber 124 is positioned below the fresh food storage chamber 122, refrigerator appliance 100 may be generally referred to as a bottom mount refrigerator. In the exemplary embodiment, housing 120 may also define a mechanical compartment (not shown) for receipt of a sealed cooling system (not shown). Using the teachings disclosed herein, one of skill in the art will understand that the present technology can be used with other types of refrigerators (e.g., side-by-side) or a freezer appliance as well. Consequently, the description set forth herein is for illustrative purposes only and is not intended to limit the technology in any aspect.

Refrigerator doors 128 may each be rotatably hinged to an edge of housing 120 for accessing fresh food chamber 122. It should be noted that while two doors 128 in a "French door" configuration are illustrated, any suitable arrangement of doors utilizing one, two or more doors is within the scope and spirit of the present disclosure. A freezer door 130 may be arranged below refrigerator doors 128 for accessing freezer chamber 124. In the exemplary embodiment, freezer door 130 is coupled to a freezer drawer (not shown) slidably mounted within freezer chamber 124. An auxiliary door 127 may be coupled to an auxiliary drawer which may be slidably mounted within an auxiliary chamber.

Operation of the refrigerator appliance 100 can be regulated by a controller 134 that is operatively coupled to a user interface panel 136. User interface panel 136 may provide selections for user manipulation of the operation of refrigerator appliance 100 to modify environmental conditions therein, such as temperature selections, etc. In some embodiments, user interface panel 136 may be proximate a dispenser assembly 132. In response to user manipulation of the user interface panel 136, the controller 134 may operate various components of the refrigerator appliance 100. Operation of the refrigerator appliance 100 may be regulated by the controller 134, e.g., controller 134 may regulate operation of various components of the refrigerator appliance 100 in response to programming and/or user manipulation of the user interface panel 136.

The controller 134 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor. It should be noted that controller 134 as disclosed herein are capable of and may be operable to perform any methods and associated method steps as disclosed herein.

The controller 134 may be positioned in a variety of locations throughout refrigerator appliance 100. In the illustrated embodiment, the controller 134 is located within the door 128. In such an embodiment, input/output ("I/O") signals may be routed between the controller and various operational components of refrigerator appliance 100. In one embodiment, the user interface panel 136 represents a general purpose I/O ("GPIO") device or functional block. In one embodiment, the user interface 136 includes input components, such as one or more of a variety of electrical, mechanical or electro-mechanical input devices including rotary dials, push buttons, and touch pads. The user interface 136 may include a display component, such as a digital or analog display device designed to provide operational feedback to a user. For example, the user interface 136 may include a touchscreen providing both input and display functionality. The user interface 136 may be in communication with the controller via one or more signal lines or shared communication busses.

Using the teachings disclosed herein, one of skill in the art will understand that the present subject matter can be used with other types of refrigerators such as a refrigerator/freezer combination, side-by-side, bottom mount, compact, and any other style or model of refrigerator appliance.

Accordingly, other configurations of refrigerator appliance 100 could be provided, it being understood that the configurations shown in the accompanying figures and the description set forth herein are by way of example for illustrative purposes only.

Figure 2:
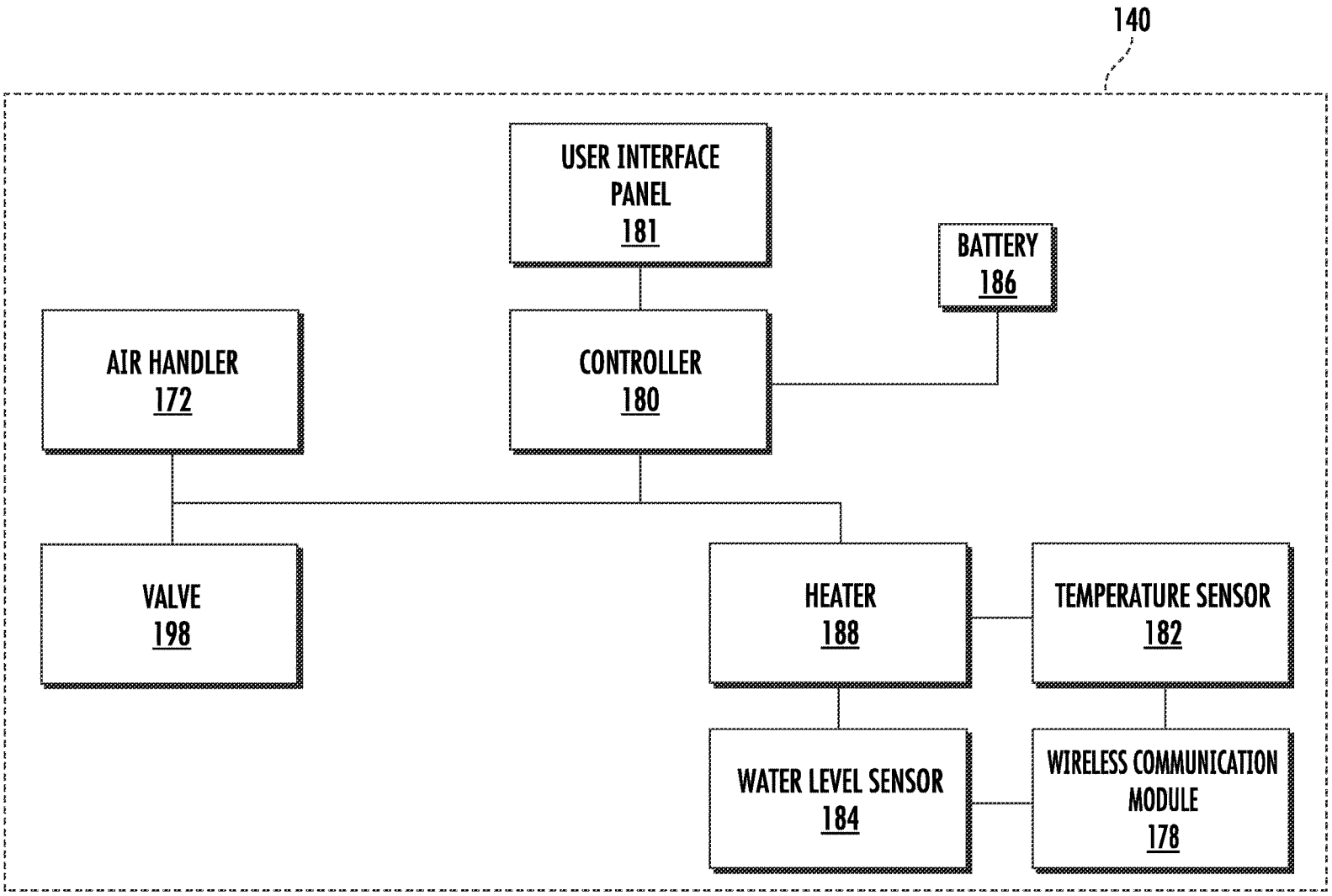
FIG. 2 provides a schematic view of an ice making appliance according to exemplary embodiments of the present disclosure.

FIG. 2 provides a schematic diagram illustrating an exemplary ice making appliance 140 according to exemplary embodiments. For instance, ice making appliance 140 may be accepted within freezer chamber 124 of refrigerator appliance 100. Additionally or alternatively, ice making appliance 140 may be provided as a stand-alone ice making appliance, capable of operation outside of refrigerator appliance 100. Accordingly, ice making appliance 140 may include a battery 186 to supply power to one or more components of ice making appliance 140 (explained in further detail below). According to at least some embodiments, battery 186 is rechargeable (e.g., via refrigerator appliance 100). For instance, refrigerator appliance 100 may include one or more charge plates which electronically engage with ice making appliance 140 (e.g., when ice making appliance is inserted into freezer chamber 124) to provide an electric charge to rechargeable battery 186. Hereinafter, a description of ice making appliance 140 will be provided in detail.

Figure 3:
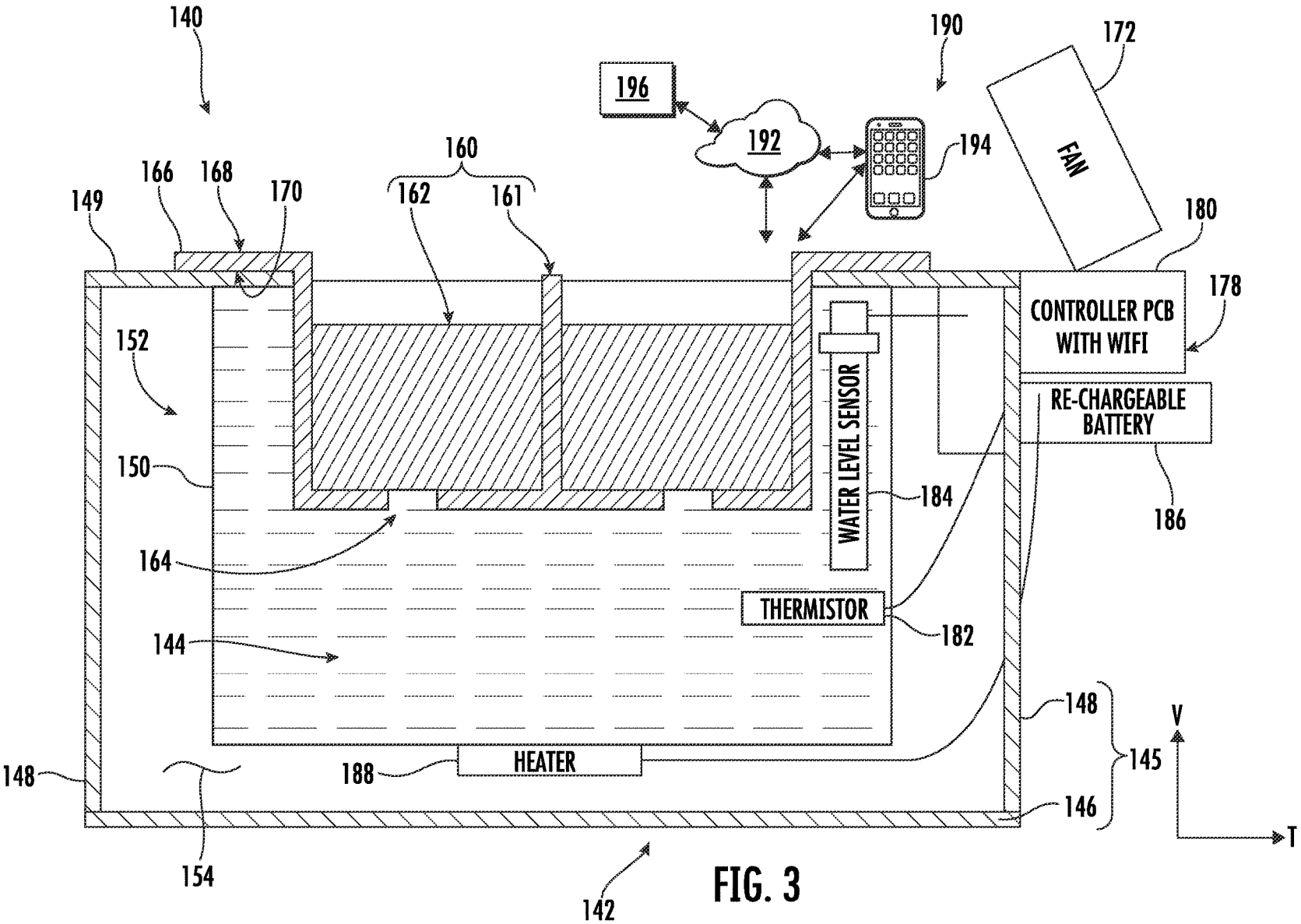
FIG. 3 provides a side cut-away view of the exemplary ice making appliance of FIG. 2.

FIG. 3 provides a cut-away view of ice making appliance 140. Referring generally to FIGS. 2 and 3, ice making appliance 140 includes a container 142. Container 142 may define a liquid reservoir 144, in which a liquid is selectively stored. In detail, container 142 may include a frame shell 145. Frame shell 145 may form an outer casing of container 142 and may include a base plate 146 and a plurality of side plates 148 extending from base plate 146. Accordingly, frame shell 145 may have a hexahedral shape. However, frame shell 145 may have any suitable shape and the disclosure is not limited to examples given herein. For instance, frame shell 145 may be unitarily formed as a single piece in any suitable shape.

Container 142 may include an inner shell or casing 150 provided within frame shell 145. According to some embodiments, inner shell 150 is shaped complementary to frame shell 145, however the disclosure is not limited to this. For instance, inner shell 150 may have a hexahedral shape smaller than the shape of frame shell 145. Moreover, liquid reservoir 144 may be defined within a cavity formed by inner shell 150. In detail, inner shell 150 is received within frame shell 145. Thus, an insulation receiving space 152 may be defined between frame shell 145 and inner shell 150 while liquid reservoir is defined within inner shell 150.

Insulation receiving space 152 may be separated from liquid reservoir 144. In detail, insulation receiving space 152 may be a sealed space (e.g., hermetically sealed or watertight) such that the liquid (e.g., water) received within liquid reservoir 144 does not seep into insulation receiving space 152. Accordingly, frame shell 145 may include a top 149. Top 149 may connect frame shell 145 with inner shell 150. For instance, with reference to FIG. 3, top 149 may extend from at least one of the plurality of side plates 148 toward liquid reservoir 144. Inner shell 150 may extend (e.g., toward the center of container 142) from top 149. As shown in FIG. 3, one or more sidewalls of inner shell 150 extend downward along the vertical direction V from top 149. According to at least some embodiments, the sidewalls of inner shell 150 are parallel with side plates 148 of frame shell 145. Additionally or alternatively, a space may be formed between a bottom of inner shell 150 and frame shell 145 as part of insulation receiving space 152. Accordingly, insulation receiving space 152 may be defined along lateral (L) and transversal (T) sides of inner shell 150 and along a bottom of inner shell 150.

An insulation 154 may be provided within the insulation receiving space 152. In detail, a heat resistant material may be provided within the insulation receiving space 152. Insulation 154 may prevent ambient heat from entering or affecting the liquid stored within liquid reservoir 144. Insulation 154 may be a foam, a fiberglass fabric, a liquid, gelatinous material, or the like. According to some embodiments, insulation receiving space 152 is provided in a vacuum state (e.g., under zero or negative pressure compared with the ambient). Additionally or alternatively, multiple forms of insulation 154 may be provided within insulation receiving space 152. Accordingly, herein, the term "insulation" may refer to any material and/or lack of pressure within insulation receiving space 152.

Ice making appliance 140 may include an ice mold 160. Ice mold 160 may be a flexible ice mold. For instance, ice mold 160 may be a silicone ice mold capable of elastic deformation. Ice mold 160 may include a body 161 which defines a plurality of cavities 162 to selectively receive liquid therein. The plurality of cavities 162 may have any suitable shape and/or size. For instance, cavities 162 may be predominantly square shaped, spherical shaped, crescent shaped, star shaped, or the like, however the disclosure is not limited to the examples given herein. Additionally or alternatively, any suitable number of cavities 162 may be provided. For instance, 2, 4, 6, 8, or 10 cavities may be provided, though the disclosure is not limited.

Ice mold 160 may include one or more apertures 164 defined therein. For instance, a distinct aperture 164 may be formed in each cavity 162 of the plurality of cavities. Apertures 164 may be defined through ice mold 160 to allow fluid communication between an interior of cavities 162 and an exterior thereof. For instance, apertures 164 may allow fluid from liquid reservoir 144 to flow into or out of the plurality of cavities 162. In some embodiments, only a single aperture 164 is formed in ice mold 160. According to these embodiments, liquid from each of the plurality of cavities 162 flows through the single aperture 164 (e.g., into liquid reservoir 144).

Apertures 164 may be formed through a bottom of ice mold 160 (e.g., along the vertical direction V). Additionally or alternatively, apertures 164 may be formed through a side (e.g., along the lateral direction L or transverse direction T) of ice mold 160. Moreover, a plurality of apertures 164 may be formed in each cavity 162. Accordingly, liquid may flow freely and easily between cavities 162 and an exterior thereof (e.g., liquid reservoir 144).

Apertures 164 may have any suitable shape (e.g., two-dimensional cross section). For instance, apertures 164 may be square, circular, ovular, or the like. Additionally or alternatively, apertures 164 may have any suitable size. For instance, a cross-sectional diameter of an aperture 164 may be between about 5% and about 15% of a cross-sectional diameter of a cavity 162. Thus, the liquid may flow between the cavities 162 and liquid reservoir 144. Moreover, apertures 164 may be formed as a series of slits in ice mold 160.

Ice mold 160 may include a flange 166. Flange 166 may extend from body 161 (e.g., along the lateral L and/or transverse T directions). For instance, flange 166 may extend from a top of body 161 outward in either the left or right direction of the lateral direction L. Additionally or alternatively, flange 166 may extend from the top of body 161 outward in either the forward or rearward direction of the transverse direction T. As seen in FIG. 3, for example, flange 166 extends outward from body 161 (e.g., away from cavities 162). Thus, flange 166 may define a top side 168 and a bottom side 170. Bottom side 170 of flange 166 may selectively rest on top 149 of frame shell 145. For instance, flange 166 may be supported by container 142 (e.g., top 149 of frame shell 145) along the vertical direction V. Accordingly, body 161 (e.g., the plurality of cavities 162) may be selectively submerged within liquid reservoir 144. In some embodiments, a fastener is included to attach flange 166 to frame shell 145. The fastener may be a snap fastener, an adhesive, a button, a latch, or the like.

Ice making appliance 140 may include a controller 180. Controller 180 may be separate from controller 134 of refrigerator appliance 100. For instance, ice making appliance 140 may include a separate and distinct controller 180 capable of controlling and operating ice making appliance 140 outside of refrigerator appliance 100. Controller 180 of ice making appliance 100 may, however, be similar to controller 134 of refrigerator appliance. For instance, controller 180 may include a memory and one or more microprocessors, CPUs or the like, such as general or special purpose microprocessors operable to execute programming instructions or micro-control code associated with operation of ice making appliance 140. The memory may represent random access memory such as DRAM, or read only memory such as ROM or FLASH. In one embodiment, the processor executes programming instructions stored in memory. The memory may be a separate component from the processor or may be included onboard within the processor. It should be noted that controller 180 as disclosed herein are capable of and may be operable to perform any methods and associated method steps as disclosed herein.

The controller 180 may be positioned in a variety of locations throughout ice making appliance 140. In the illustrated embodiment, the controller 180 is attached to container 142. In such an embodiment, input/output ("I/O") signals may be routed between the controller and various operational components of ice making appliance 140. In one embodiment, a user interface panel 181 represents a general purpose I/O ("GPIO") device or functional block. In one embodiment, the user interface 181 includes input components, such as one or more of a variety of electrical, mechanical or electro-mechanical input devices including rotary dials, push buttons, and touch pads. The user interface 181 may include a display component, such as a digital or analog display device designed to provide operational feedback to a user. For example, the user interface 181 may include a touchscreen providing both input and display functionality. The user interface 181 may be in communication with the controller via one or more signal lines or shared communication busses.

Additionally or alternatively, controller 180 may include a wireless communication module 178. Wireless communication module 178 may communicate with, e.g., a remote user device. As would be understood, wireless communication module 178 may also be connected with a rechargeable battery (described below). A separate user interface 181 (e.g., different from user interface panel 136 of refrigerator appliance 100) may be provided on ice making appliance 140. The separate user interface 181 may allow a user to interact directly with ice making appliance 140. The user interface 181 may be operably connected with controller 180 (e.g., via one or more wired or wireless connection channels).

Ice making appliance 140 may include a temperature sensor 182. Temperature sensor 182 may be provided within container 142. For instance, temperature sensor 182 may be positioned within liquid reservoir 144 to detect and monitor a temperature of the liquid stored within liquid reservoir 144. According to some embodiments, temperature sensor 182 is located external to the plurality of cavities 162 of ice mold 160. Thus, temperature sensor 182 may be located adjacent to ice mold 160. Moreover, temperature sensor 182 may be attached to inner shell 150 of container 142. Temperature sensor 182 may be operably connected with controller 180 of ice making appliance, and may routinely send temperature signals to controller 180.

As used herein, "temperature sensor" or the equivalent is intended to refer to any suitable type of temperature measuring system or device positioned at any suitable location for measuring the desired temperature. Thus, for example, temperature sensor 182 may each be any suitable type of temperature sensor, such as a thermistor, a thermocouple, a resistance temperature detector, a semiconductor-based integrated circuit temperature sensors, etc. In addition, temperature sensor 182 may be positioned at any suitable location and may output a signal, such as a voltage, to a controller that is proportional to and/or indicative of the temperature being measured. Although exemplary positioning of temperature sensors is described herein, it should be appreciated that ice making appliance 140 may include any other suitable number, type, and position of temperature and/or other sensors according to alternative embodiments.

Ice making appliance 140 may include a water level sensor 184. Water level sensor 184 may be provided within container 142. For instance, water level sensor 184 may be positioned within liquid reservoir 144 to detect and monitor a volume, level, mass, or amount of the liquid stored within liquid reservoir 144. For instance, water level sensor 184 may be a float sensor or switch, a Hall effect sensor, an ultrasonic sensor, an optical interface sensor, or the like. According to some embodiments, water level sensor 184 is located external to the plurality of cavities 162 of ice mold 160. Thus, water level sensor 184 may be located adjacent to ice mold 160. Moreover, water level sensor 184 may be attached to inner shell 150 of container 142.

Water level sensor 184 may be operably connected with controller 180 of ice making appliance. Since the plurality of cavities 162 are fluidly connected with liquid reservoir 144, controller 180 may accurately determine a level of liquid within each of liquid reservoir 144 and each of the plurality of cavities 162. However, it should be noted that additional or alternative methods may be utilized in determining a level of liquid within the plurality of cavities 162. In detail, a flow meter may be provided (e.g., attached to a water fill tube (described below)) which may detect an amount of liquid (e.g., water) is dispensed into the plurality of cavities 162. Further, controller 180 may measure an amount of time for which a fill valve (described below) is activated and determine an amount of liquid supplied to the plurality of cavities 162 according to a known flow rate. It should be appreciated that other methods and means of determining an amount of water within liquid reservoir 144 and the plurality of cavities may be incorporated.

Ice making appliance 140 may include a rechargeable battery 186. For instance, rechargeable battery 186 may be provided on a printed circuit board (PCB) within or attached to container 142. Rechargeable battery 186 may be in electrical communication with and selectively provide power to, for example, temperature sensor 182, water level sensor 184, a heater 188 (described below), a fan 172 (described below), or a user interface 181 provided on ice making appliance 140. According to at least some embodiments, rechargeable battery 186 is selectively recharged by refrigerator appliance 100. For instance, ice making appliance 140 may be placed within freezing chamber 124 (e.g., while in use or while not in use). Upon closing freezer door 130, an electrical connection may be established between rechargeable battery 186 and a power source within refrigerator appliance 100.

For one example, as described above, refrigerator appliance 100 includes a first contact charge plate and ice making appliance 140 includes a second contact charge plate. When freezer door 130 is closed (with ice making appliance 140 provided therein), the first contact charge plate contacts the second contact charge plate. Electrical power (e.g., from a home power source) is supplied from the first contact charge plate to the second contact charge plate. The electrical power may then be supplied to rechargeable battery 186. Thus, rechargeable battery 186 may be recharged to allow ice making appliance 140 to operate outside of the confines of refrigerator appliance 100. Moreover, rechargeable battery 186 may be any suitable type of battery capable of being recharged, such as a Lithium Ion (Li-ion) battery, a Lithium-ion polymer (Li-ion polymer) battery, a lead-acid battery, a Zinc-air battery, a Nickel-Cadmium (NiCd) battery, a Nickel-metal hydride (NiMH) battery, or the like.

Ice making appliance 140 may include a heater 188. Heater 188 may be provided within insulation receiving space 152. According to at least one example, heater 188 is attached to a bottom of inner shell 150 (e.g., within insulation receiving space 152). Heater 188 may be operably connected with controller 180 and rechargeable battery 186. Accordingly, power may be selectively applied to operate heater 188 according to predetermined inputs (e.g., according to time, schedule, detected water levels or water temperatures, etc.). Heater 188 may be any suitable type of heater capable of producing and emitting heat energy. For instance, heater 188 may be an electric resistance heating element, a radiant heating element, an induction heating element, or the like. Additionally or alternatively, heater 188 may be any appropriate shape or size (e.g., to fit within insulation receiving space 152).

Ice making appliance 140 may include an air handler or fan 172. Air handler 172 may be provided adjacent to container 142. In detail, air handler 172 may selectively direct a flow of air (e.g., cooling air) over a top of ice mold 160. Accordingly, air handler 172 may be operably connected with controller 180 and rechargeable battery 186. According to some embodiments, air handler 172 is positioned above container 142 along the vertical direction V. Moreover, air handler 172 may be positioned at a lateral L or transverse T side of container 142. Thus, cool air may be supplied to ice mold 160 to form ice cubes more efficiently within cavities 162. According to the illustrated exemplary embodiment, air handler 172 is an axial fan. However, it should be appreciated that according to alternative embodiments, air handler 172 may be positioned at any other suitable location and may be any other suitable blower or fan type, such as a tangential fan, a centrifugal fan, etc. In addition, according to an exemplary embodiment, air handler 172 is a variable speed fan such that it may rotate at different rotational speeds, thereby generating different air flow rates.

Figure 4:
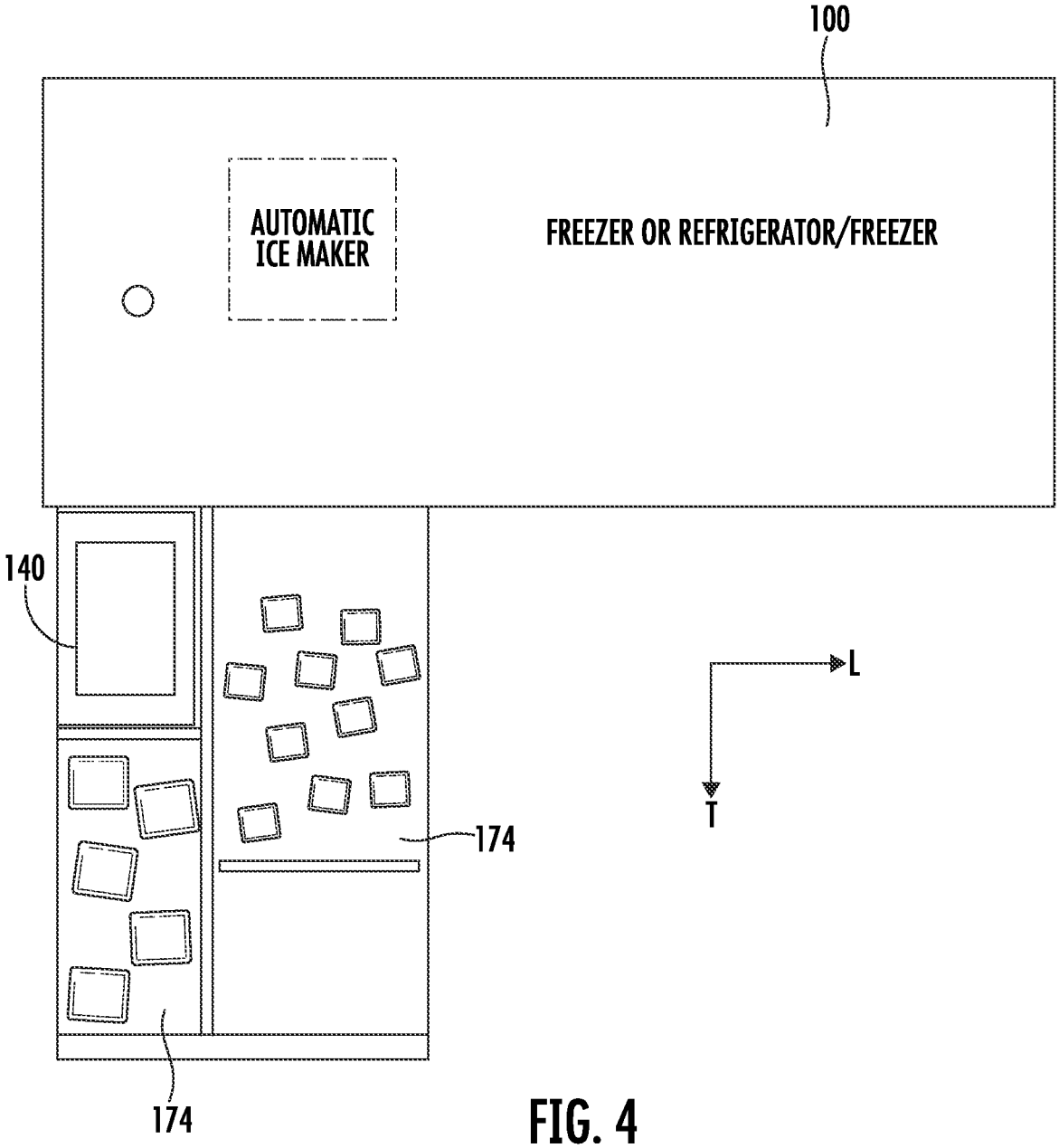
FIG. 4 provides a top schematic view of the exemplary refrigerator appliance of FIG. 1.
Figure 5:
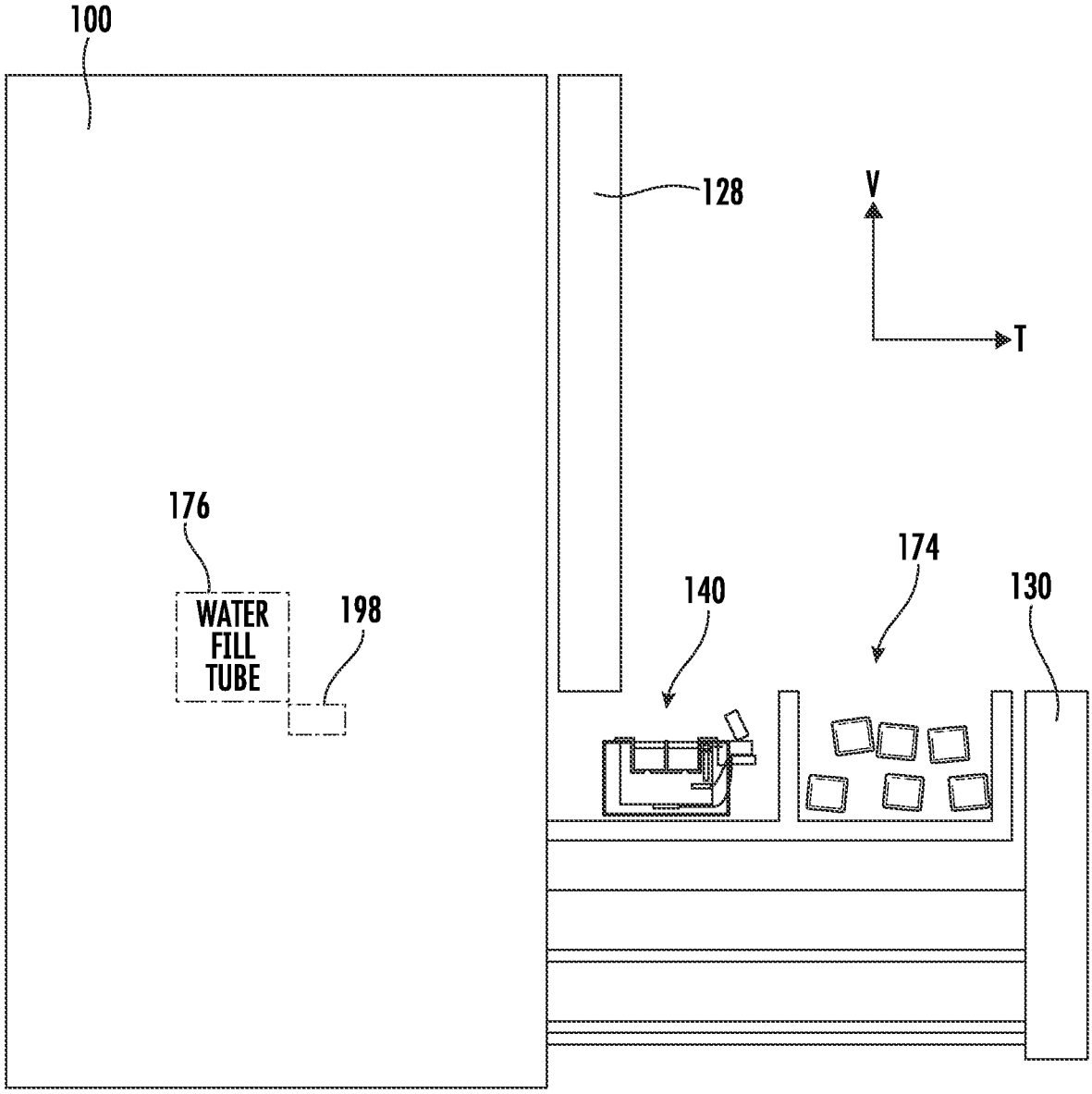
FIG. 5 provides a side schematic view of the exemplary refrigerator appliance of FIG. 4.

Referring now to FIGS. 4 and 5, embodiments of ice making appliance 140 provided within refrigerator appliance 100 will be described. As shown in the figures, ice making appliance 140 may be positioned within freezing chamber 124 of refrigerator appliance 100. For the embodiment illustrated and described herein, freezing chamber 124 is positioned as a bottom mount freezer having a drawer. Ice making appliance may be removably received within the drawer (e.g., freezer door 130). Accordingly, a user may selectively remove ice making appliance 100 from freezing chamber 124 to empty liquid reservoir 144, to use as a stand-alone ice making appliance, or the like.

Freezing chamber 124 may include one or more ice storage compartments 174. Ice storage compartments 174 may be accommodated within freezer door 130 (e.g., when freezer door 130 is a pull-out drawer style). As shown particularly in FIG. 4, at least two ice storage compartments 174 may be formed or otherwise defined by the corresponding drawer. In detail, a drawer may be partitioned into a plurality of ice storage compartments 174, as well as a receiving space for ice making appliance 100. A user may utilize one or more ice storage compartments 174 to store ice shapes formed in ice making appliance 100, and one or more different ice storage compartments 174 to store ice from an alternate source. Additionally or alternatively, it should be noted that ice storage compartments 174 may be utilized for storage of any other suitable items, such as food items, medicine, ice packs, or the like.

Further to the embodiment described above, refrigerator appliance 100 may include a water fill tube 176. Water fill tube 176 may be positioned at least partially within freezing chamber 124. Water fill tube 176 may be a tube or hose having a first end connected with a water or liquid supply (such as a municipal water supply or a built-in refrigerator water supply) and a second end positioned above ice mold 160. For instance, water fill tube 176 may be formed from a plastic or plastic compound, such as a polyvinyl or composite material in order to be flexible while retaining strength. Accordingly, water fill tube 176 may deliver or supply liquid (e.g., water) to ice mold 160 from refrigerator appliance 100 according to a schedule or according to one or more inputs from a user.

A fill valve 198 may be provided on water fill tube 176. In detail, fill valve 198 may selectively allow the release of liquid from water fill tube 176 (e.g., into cavities 162 of ice mold 160). Fill valve 198 may thus be positioned at or near the second end (e.g., distal end) of water fill tube 176. However, a precise placement of fill valve 198 is not limited by this disclosure, and any suitable position may be used. Fill valve 198 may be an electronic valve, for example. Accordingly, fill valve 198 may be operably connected with controller 180 (or controller 134 of refrigerator appliance 100). Thus, water or liquid may be selectively released from water fill tube 176 via fill valve 198 according to predetermined schedules, one or more inputs, one or more triggers, a combination of the above, or the like. For one example, fill valve 198 receives a signal from controller 180 (or controller 134) when ice making appliance 140 is present within freezer chamber 124 and freezer door 130 is in a closed position. The signal may be an activation signal, a fill signal, an open signal, or the like. Accordingly, fill valve 198 is adjusted to an open position to allow water to flow from water fill tube 176 into ice mold 160. Fill valve 198 may then receive a close signal or end signal from controller 180 (or controller 134) at a conclusion of the fill process. The end signal may be delivered after a predetermined amount of time such that ice mold 160 is sufficiently filled. For one example, the end signal is delivered when water level sensor 184 determines that a level of liquid within liquid reservoir 144 (and subsequently within ice mold 160) is at a predetermined fill level.

Referring still to FIG. 3, a schematic diagram of an external communication system 190 will be described according to an exemplary embodiment of the present subject matter. In general, external communication system 190 is configured for permitting interaction, data transfer, and other communications with refrigerator appliance 100 and/or ice making appliance 140. For example, this communication may be used to provide and receive operating parameters, cycle settings, performance characteristics, user preferences, user notifications, or any other suitable information for improved performance of ice making appliance 140.

External communication system 190 permits controller (e.g., controller 134 or 180) of refrigerator appliance 100 or ice making appliance 140 to communicate with external devices either directly or through a network 192. For example, a consumer may use a consumer device 194 to communicate directly with ice making appliance 140. For example, consumer devices 194 may be in direct or indirect communication with ice making appliance 140, e.g., directly through a local area network (LAN), Wi-Fi, Bluetooth, Zigbee, etc. or indirectly through network 192. In general, consumer device 194 may be any suitable device for providing and/or receiving communications or commands from a user. In this regard, consumer device 194 may include, for example, a personal phone, a tablet, a laptop computer, or another mobile device.

In addition, a remote server 196 may be in communication with ice making appliance 140 and/or consumer device 194 through network 192. In this regard, for example, remote server 196 may be a cloud-based server 196, and is thus located at a distant location, such as in a separate state, country, etc. In general, communication between the remote server 196 and the client devices may be carried via a network interface using any type of wireless connection, using a variety of communication protocols (e.g., TCP/IP, HTTP, SMTP, FTP), encodings or formats (e.g., HTML, XML), and/or protection schemes (e.g., VPN, secure HTTP, SSL).

In general, network 192 can be any type of communication network. For example, network 192 can include one or more of a wireless network, a wired network, a personal area network, a local area network, a wide area network, the internet, a cellular network, etc. According to an exemplary embodiment, consumer device 194 may communicate with a remote server 196 over network 192, such as the internet, to provide user inputs, transfer operating parameters or performance characteristics, receive user notifications or instructions, etc. In addition, consumer device 194 and remote server 196 may communicate with ice making appliance 140 to communicate similar information.

External communication system 190 is described herein according to an exemplary embodiment of the present subject matter. However, it should be appreciated that the exemplary functions and configurations of external communication system 190 provided herein are used only as examples to facilitate description of aspects of the present subject matter. System configurations may vary, other communication devices may be used to communicate directly or indirectly with one or more appliances, other communication protocols and steps may be implemented, etc. These variations and modifications are contemplated as within the scope of the present subject matter.

Figure 6:
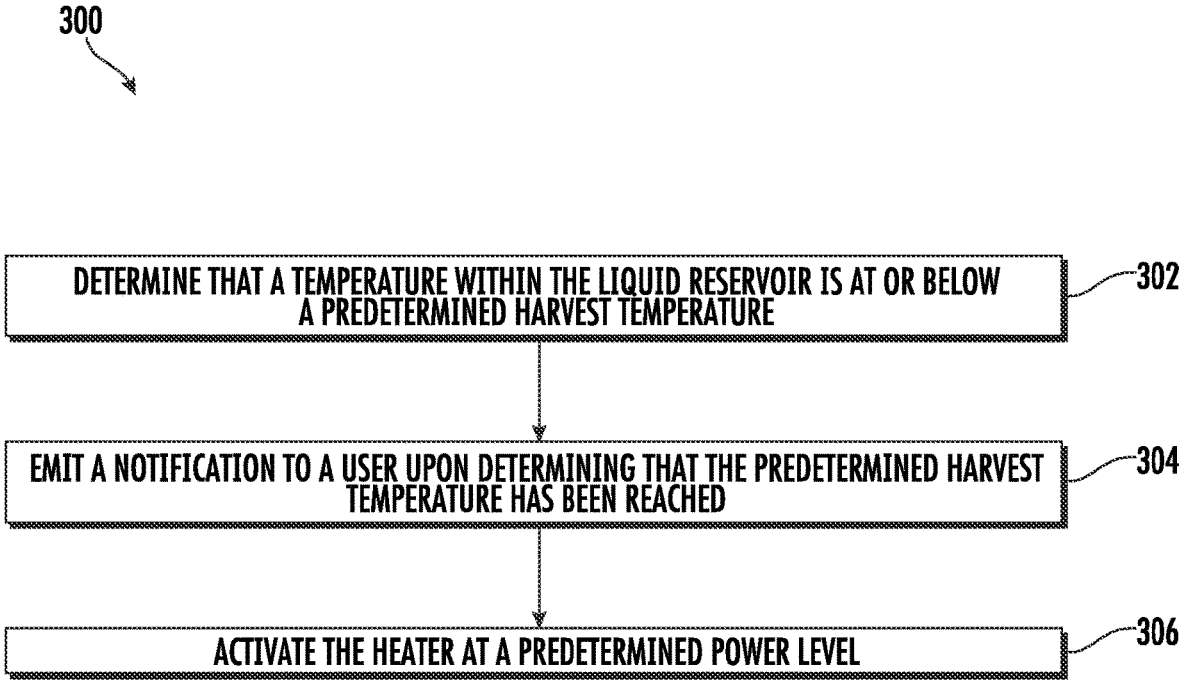
FIG. 6 provides an exemplary method of operating the ice making appliance of FIG. 2.

Referring now to FIG. 6, a method of operating an ice making appliance (e.g., ice making appliance 140) or a refrigerator appliance (e.g., refrigerator appliance 100) will be described in detail. For instance, method 300 relates to emitting a notification to a user as to the process of an ice forming process. Although the discussion below refers to the exemplary method 300 of operating ice making appliance 100, one skilled in the art will appreciate that the exemplary method 300 is applicable to any suitable domestic appliance. In exemplary embodiments, the various method steps as disclosed herein may be performed by ice making controller 180, refrigerator controller 134, and/or a separate, dedicated controller.

At step 302, method 300 include determining that a temperature within the liquid reservoir is at or below a predetermined temperature. For instance, a controller (e.g., controller 180) may determine that a detected temperature (e.g., via temperature sensor 182) within a liquid reservoir (e.g., liquid reservoir 144) is at or below a predetermined or prestored temperature signifying the presence of ice within an ice mold (e.g., ice mold 160). In detail, the temperature sensor detects the temperature of the liquid within the liquid reservoir. Subsequently, the detected temperature is compared to a predetermined temperature stored on board the ice making appliance. The predetermined temperature may be established to indicate that the liquid within the ice mold is frozen while the liquid within the liquid reservoir is not.

For the ice making appliance described herein, a ballast method of forming clear ice cubes is used. In detail, the liquid (e.g., water) provided within the ice mold freezes before the liquid within the liquid reservoir, into which the ice mold is submerged. As the liquid within the ice mold freezes, impurities are driven from cavities of the ice mold into the liquid reservoir (e.g., via apertures 164). The liquid within the ice mold thus freezes as clear ice before the liquid within the liquid reservoir freezes, forming clear ice.

Accordingly, the controller (via the temperature sensor) may continually or regularly monitor a temperature of the liquid within the liquid reservoir. The user may set a specific temperature to be reached, or the controller may calculate the proper temperature to identify the formation of ice within the ice mold. When the predetermined temperature has been reached (e.g., in response to the same), method 300 may proceed to step 304.

At step 304, method 300 includes emitting a notification to a user upon determining that the predetermined harvest temperature has been reached. In detail, the controller may activate a wireless communication module within the controller to send a notification to a remote terminal (e.g., consumer device 194) to alert the user. The notification may be sent in any suitable manner, such as through an application as a push notification, through a text message, an email, or the like. The notification may alert the user as to the detected temperature within the liquid reservoir. Additionally or alternatively, the notification may alert the user as to the presence of ice within the ice mold, an amount of time before the liquid reservoir freezes as well, an alert to perform a harvesting operation, or a combination of two or more of these notifications.

Additionally or alternatively, the controller may present one or more options to select via the notification. For instance, the notification may include a prompt to instruct the ice making appliance to perform one or more actions. According to some embodiments, the notification includes a prompt to activate a heater (e.g., heater 188) within the ice making appliance. In detail, the user may instruct, via the remote device, the ice making appliance to activate the heater at a predetermined power level. Advantageously, the ice making appliance may prolong the freezing of the liquid reservoir (e.g., even if a user is unable to immediately harvest ice).

Accordingly, at step 306, method 300 includes activating the heater at the predetermined power level. As mentioned above, the heater may be operably connected to the controller and a rechargeable battery. Thus, the controller may instruct the heater to receive power at a predetermined level to emit heat to the liquid reservoir. Optionally, the heater may be activated for a predetermined length of time. For instance, the user may, via the remote device, instruct the heater to be activated for about 5 minutes, for about 10 minutes, or for about 20 minutes. It should be understood that any suitable amount of time may be selected or input by the user. According to one example, the heater is activated according to a duty cycle. For instance, the heater may be activated for the predetermined length of time and then deactivated. The heater may remain deactivated for another predetermined length of time (which may be the same as or different from the activation predetermined length of time). The user may again be notified of the completion of the ice forming process. The duty cycle may be repeated until the user opens the freezer door, for example.

Following heater activation (e.g., at least a portion thereof), the user may then perform a harvest of the ice shapes by retrieving the ice mold from the liquid reservoir. The ice shapes may be relocated to an ice storage compartment (e.g., ice storage compartment 174) or may be used for any suitable purpose. The user may then empty the liquid reservoir (e.g., via an external drain) and may reposition the ice making appliance within the freezing chamber 124. Upon replacing the ice making appliance, an ice making operation may commence automatically (e.g., via a water fill tube provided within the refrigerator appliance).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An icemaker appliance defining a vertical direction, a lateral direction, and a transverse direction, the icemaker appliance comprising:

a container defining a single liquid reservoir storing a liquid, wherein the container comprises:

a frame shell, an inner shell provided within the frame shell, wherein the frame shell and the inner shell collectively define an insulation receiving space therebetween, and a top connecting the frame shell with the inner shell, wherein a length of the top along the transverse direction is greater than a distance between the frame shell and the inner shell along the transverse direction such that a portion of the top is positioned over the single liquid reservoir;

an ice mold selectively received within a portion of the liquid reservoir, the ice mold defining a plurality of cavities accepting the liquid therein, wherein each of the plurality of cavities is received within the single liquid reservoir;

a temperature sensor provided within the liquid reservoir and configured to monitor a temperature of the liquid surrounding the ice mold; and a controller attached to the container, the controller being operably connected with the temperature sensor, the controller comprising a wireless communication module configured to wirelessly communicate with a remote terminal, wherein the controller is configured to perform an operation, the operation comprising:

determining, via the temperature sensor, that a temperature within the liquid reservoir is at or below a predetermined harvest temperature; and emitting a notification to a user upon determining that the predetermined harvest temperature has been reached, wherein the notification comprises a prompt to activate a heater to selectively provide heat to the liquid reservoir.

2. The icemaker appliance of claim 1, further comprising:

a water level sensor provided within the liquid reservoir and operably connected with the controller, the water level sensor being configured to determine a level of the liquid within the container;

a liquid fill tube provided above the ice mold; and a valve provided on the liquid fill tube and operably connected with the controller, wherein the valve selectively releases liquid into the ice mold.

3. The icemaker appliance of claim 1, further comprising a rechargeable battery attached to the container, wherein the rechargeable battery provides power to the controller.

4. The icemaker appliance of claim 1, wherein the ice mold comprises:

a body, the body forming the plurality of cavities; and a flange extending from the body perpendicular to the vertical direction, wherein the flange is supported by the container along the vertical direction.

5. The icemaker appliance of claim 4, wherein the ice mold further comprises:

one or more apertures defined in the body, the one or more apertures allowing fluid communication between the plurality of cavities and the liquid reservoir.

6. The icemaker appliance of claim 5, wherein each of the plurality of cavities comprises an aperture of the one or more apertures.

7. The icemaker appliance of claim 1, wherein the container comprises:

a frame shell defining an insulation receiving space separated from the liquid reservoir; and an insulation provided within the insulation receiving space.

8. The icemaker appliance of claim 7, wherein the heater is provided within the insulation receiving space and operably connected with the controller.

9. The icemaker appliance of claim 1, further comprising:

an air handler attached to the container and operably connected with the controller, wherein the air handler urges a flow of air over a top of the ice mold.

10. A refrigerator appliance defining a vertical direction, a lateral direction, and a transverse direction, the refrigerator appliance comprising:

a cabinet defining a fresh food chamber and a freezer chamber; and an icemaker provided within the freezer chamber, wherein the icemaker comprises:

a container defining a single liquid reservoir storing a liquid, wherein the container comprises:

a frame shell, an inner shell provided within the frame shell, wherein the frame shell and the inner shell collectively define an insulation receiving space therebetween, and a top connecting the frame shell with the inner shell, wherein a length of the top along the transverse direction is greater than a distance between the frame shell and the inner shell along the transverse direction such that a portion of the top is positioned over the single liquid reservoir;

an ice mold selectively received within a portion of the liquid reservoir, the ice mold defining a plurality of cavities accepting the liquid therein, wherein each of the plurality of cavities is received within the single liquid reservoir;

a temperature sensor provided within the liquid reservoir and configured to monitor a temperature of the liquid surrounding the ice mold; and a controller attached to the container, the controller being operably connected with the temperature sensor, the controller comprising a wireless communication module configured to wirelessly communicate with a remote terminal, wherein the controller is configured to perform an operation, the operation comprising:

determining, via the temperature sensor, that a temperature within the liquid reservoir is at or below a predetermined harvest temperature; and emitting a notification to a user upon determining that the predetermined harvest temperature has been reached, wherein the notification comprises a prompt to activate a heater to selectively provide heat to the liquid reservoir.

11. The refrigerator appliance of claim 10, further comprising:

a water level sensor provided within the liquid reservoir and operably connected with the controller, the water level sensor being configured to determine a level of the liquid within the container;

a liquid fill tube provided above the ice mold; and a valve provided on the liquid fill tube and operably connected with the controller, wherein the valve selectively releases liquid into the ice mold.

12. The refrigerator appliance of claim 10, further comprising a rechargeable battery attached to the icemaker, wherein the rechargeable battery provides power to the controller and is recharged by the refrigerator appliance.

13. The refrigerator appliance of claim 10, wherein the ice mold comprises:

a body, the body forming the plurality of cavities; and a flange extending from the body perpendicular to the vertical direction, wherein the flange is supported by the container along the vertical direction.

14. The refrigerator appliance of claim 13, wherein the ice mold further comprises:

one or more apertures defined in the body, the one or more apertures allowing fluid communication between the plurality of cavities and the liquid reservoir.

15. The refrigerator appliance of claim 14, wherein each of the plurality of cavities comprises an aperture of the one or more apertures.

16. The refrigerator appliance of claim 10, wherein the container comprises:

a frame shell defining an insulation receiving space separated from the liquid reservoir; and an insulation provided within the insulation receiving space.

17. The refrigerator appliance of claim 16, wherein the heater is provided within the insulation receiving space and operably connected with the controller.

18. The refrigerator appliance of claim 10, wherein the icemaker further comprises:

an air handler attached to the container and operably connected with the controller, wherein the air handler urges a flow of air over a top of the ice mold.

* * * * *